US007746353B2

(12) United States Patent
Cazier et al.

(10) Patent No.: US 7,746,353 B2
(45) **Date of Patent: *Jun. 29, 2010**

(54) BORDER FRAME COLOR PICKER

(75) Inventors: Robert P. Cazier, Fort Collins, CO (US); Murray Dean Craig, Johnstown, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 583 days.

This patent is subject to a terminal disclaimer.

(21) Appl. No.: 11/606,548

(22) Filed: Nov. 29, 2006

(65) Prior Publication Data

US 2008/0122859 A1 May 29, 2008

(51) Int. Cl.
*G09G 5/02* (2006.01)

(52) U.S. Cl. ..... 345/593; 345/589; 345/594; 345/595; 345/619; 345/642; 345/661; 715/856; 382/199

(58) Field of Classification Search ..... 345/595, 345/642

See application file for complete search history.

(56) References Cited

U.S. PATENT DOCUMENTS

| | | | | |
|---|---|---|---|---|
| 5,872,555 | A * | 2/1999 | Kolar et al. | 345/594 |
| 6,587,596 | B1 * | 7/2003 | Haeberli | 382/283 |
| 7,102,682 | B2 | 9/2006 | Baer | |
| 7,424,147 | B2 * | 9/2008 | Obrador | 382/162 |
| 2005/0069199 | A1 * | 3/2005 | Lipsky et al. | 382/162 |
| 2006/0257023 | A1 * | 11/2006 | Obrador | 382/173 |
| 2007/0165952 | A1 * | 7/2007 | Goto | 382/199 |

* cited by examiner

*Primary Examiner*—Antonio A Caschera

(57) ABSTRACT

An embodiment of the invention provides an apparatus and method of selecting a color for a border frame. The apparatus and method permit a selector to be placed on an object image and select a color for the border frame, based on a location of the selector on the object image.

15 Claims, 6 Drawing Sheets

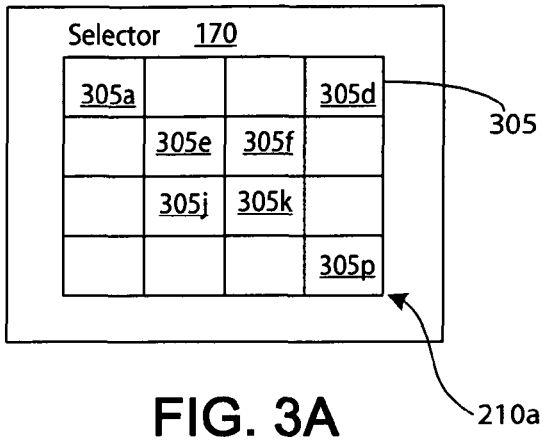
FIG. 3A
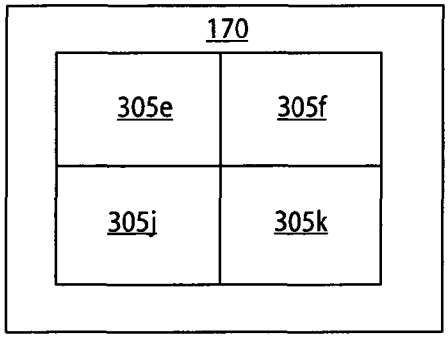
FIG. 3B
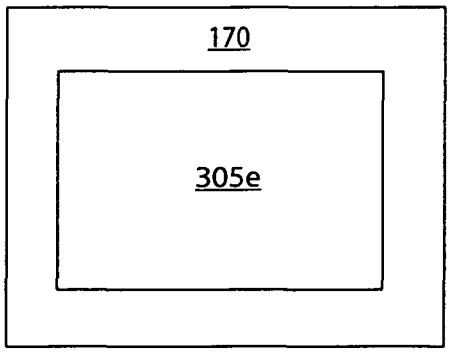
FIG. 3C
FIG. 3
| |
|---|
| FIG. 3A |
| FIG. 3B |
| FIG. 3C |
| FIG. 3D |
| FIG. 3E |

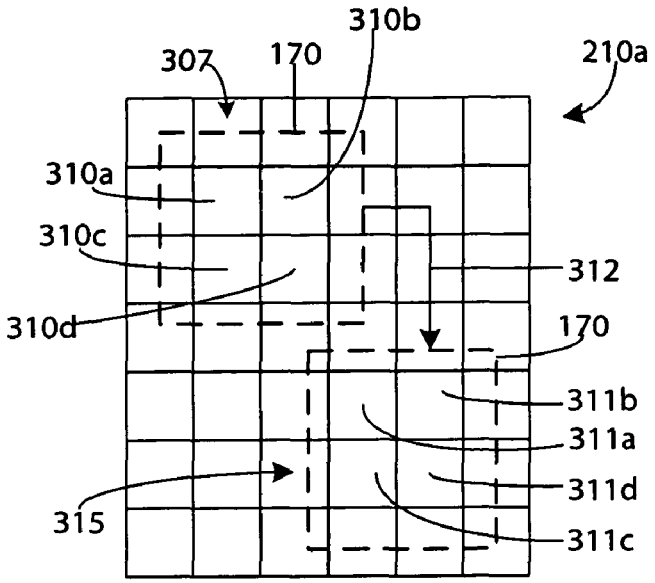
FIG. 3D
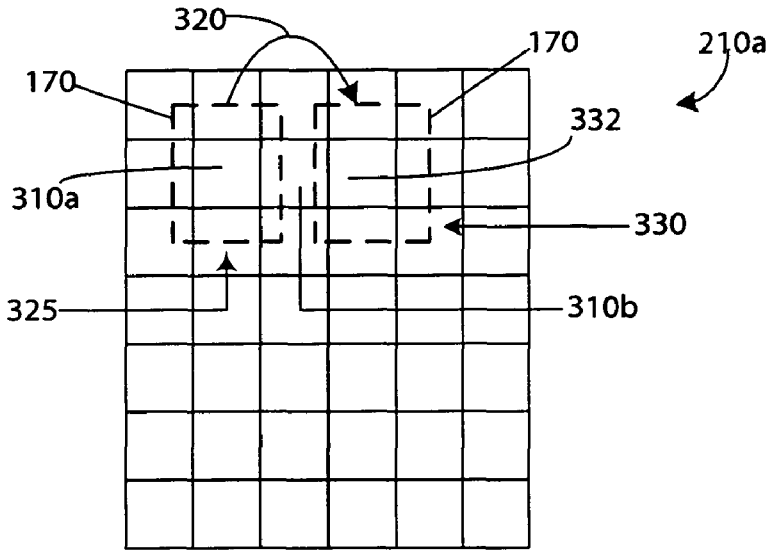
FIG. 3E
FIG. 3
| |
|---|
| FIG. 3A |
| FIG. 3B |
| FIG. 3C |
| FIG. 3D |
| FIG. 3E |

BORDER FRAME COLOR PICKER

BACKGROUND

In current digital camera technology, a user can select a border frame around an image in a picture. A current digital camera typically has a border feature where the user can preview the picture in order to see how the picture appears with a selected border frame color. In one current solution, a user is limited to selecting the border frame color from among a fixed set of colors in a color palette (a selection of colors or a color set). In another current solution, the digital camera automatically picks the border frame color from a color palette with a fixed limited number of color values. Current solutions also use the color palette in order to pick a border frame color for gray-scale (black and white) images. Since the color palette is used for determining a border frame color of a gray-scale image, the current solutions perform the unnecessary step of analyzing inappropriate non-grayscale color selection possibilities for the border frame. Therefore, the current technology is limited in its capabilities and suffers from at least the above constraints and deficiencies.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIG. 3 shows various diagrams that illustrate various methods for selecting a color or (colors) in an image in order to determine a color for the border, in accordance with other embodiments of the invention.

DETAILED DESCRIPTION OF PREFERRED EMBODIMENTS

In the description herein, numerous specific details are provided, such as examples of components and/or methods, to provide a thorough understanding of embodiments of the invention. One skilled in the relevant art will recognize, however, that an embodiment of the invention can be practiced without one or more of the specific details, or with other apparatus, systems, methods, components, materials, parts, and/or the like. In other instances, well-known structures, materials, or operations are not shown or described in detail to avoid obscuring aspects of embodiments of the invention.

Figure 1:
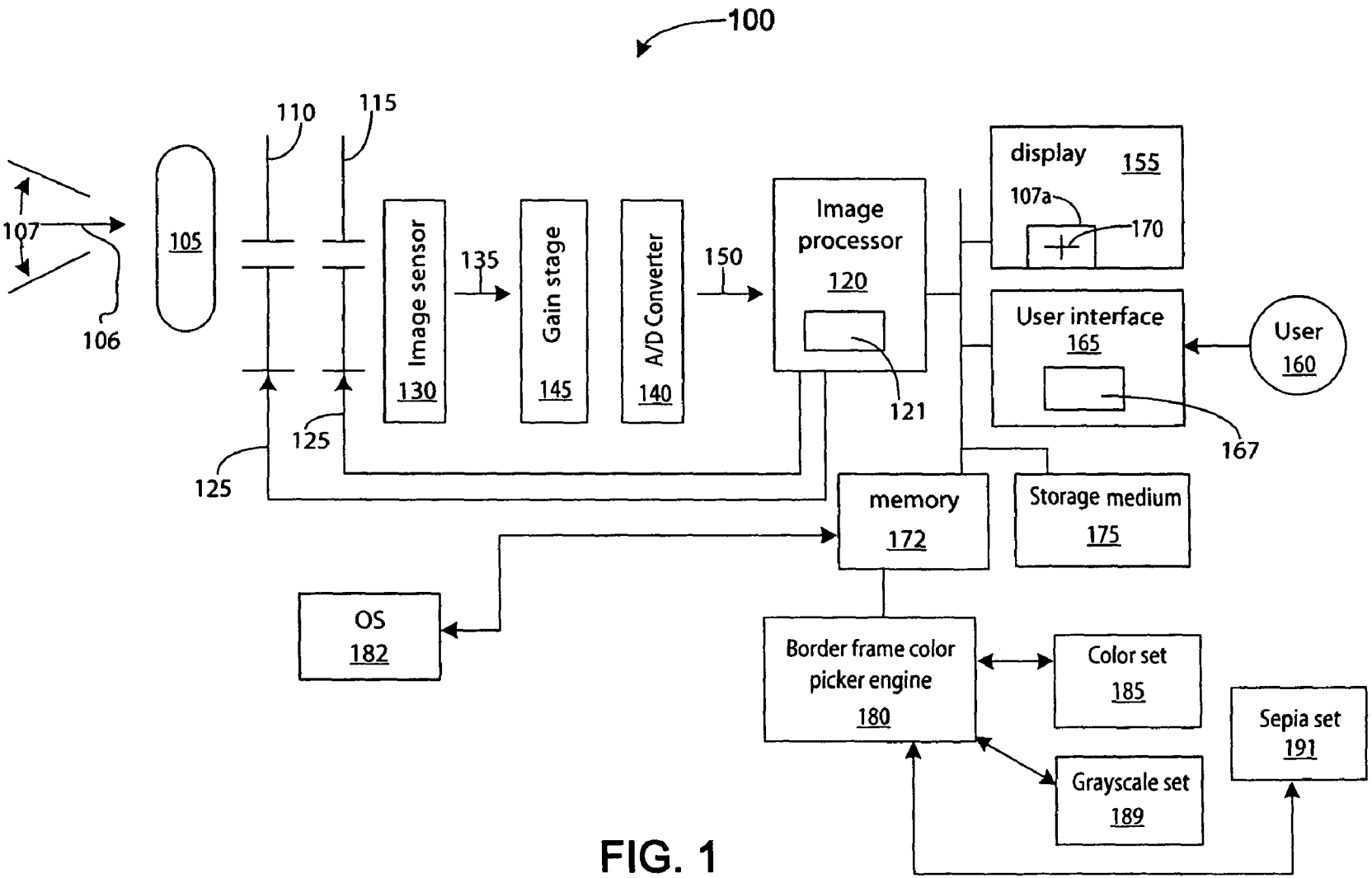
FIG. 1 is a block diagram of an apparatus (system) in accordance with an embodiment of the invention.

FIG. 1 is a block diagram of an apparatus (system) 100 in accordance with an embodiment of the invention. The apparatus 100 is typically implemented in a digital camera or other suitable digital imaging devices. The apparatus 100 includes a lens 105 that conducts light 106 from an image scene 107 through an aperture 110 and a shutter 115. An image processor 120 controls the aperture 110 and shutter 115 via control signals 125. The aperture 110 and shutter 115 may be implemented by any known mechanisms that are used in camera technology.

An image sensor stage 130 can be formed by, for example, an array of CCD (charge coupled devices) sensors or an array of CMOS (complementary metal oxide semiconductor) sensors, or other suitable types of sensors that may be developed as sensor technology continues to advance. Each sensor in the array is commonly referred to as a "pixel" and an image scene 107 that is sampled by the image sensor stage 130 is treated as an array of pixel samples that have color values stored in the memory 172.

Light 106 from an image scene 107 is received by the lens 105 and is transmitted through the aperture 110 and the shutter 115. In response to the light 106, the image sensor stage 130 generates a set of pixel samples 135, which are electrical signals. The pixel samples 135 are converted from analog electrical signals to digital electrical signals by an analog-to-digital (A/D) converter 140. Typically, a gain stage 145 is provided between the image sensor stage 130 and the A/D converter 140. In the embodiment of FIG. 1, the gain stage 145 is included, although another embodiment of the invention may not make use of a gain stage. The gain stage 145 provides gain to the pixel samples 135 so that the A/D converter 140 can perform accurate analog-to-digital conversion of the pixel samples 135.

The A/D converter 140 digitizes the pixel samples 135 into the corresponding digitized pixel samples 150. Each digitized pixel sample 150 is a digital value that indicates a charge amplitude from a corresponding sensor in the image sensor stage 130. The A/D converter 140 provides the corresponding digitized pixel samples 150 to the image processor 120.

A display 155 permits a user 160 to view an image 107*a* of the scene 107. The display 155 may be, for example, a liquid crystal display (LCD) or other types of screens.

The user 160 can also use a user interface 165 to control various operations in the apparatus 100. For example the user interface 165 includes buttons or other types of actuators to permit control of camera functions. The user 160 can also use the interface 165 to control the movement and position of an area selector 170. As an example, the area selector 170 can be cross-hairs 170. Note that the area selector 170 can have other shapes and forms. For example, the area selector 170 can instead be a square, circular, rectangular, a cursor, or other pre-defined shaped area that is imposed on the display 155. For purposes of clarity, in the examples discussed below, the selector 170 is assumed to be a cross-hair.

The apparatus 100 also includes a memory 172 and storage medium 175. The apparatus 100 also includes known camera components that are not shown in FIG. 1 for purposes of clarity in the drawings. For example, the power supply and other actuators or mechanisms that can be used for the apparatus 100 are not shown in FIG. 1 for purposes of clarity.

The memory 172 can store a border frame color picker engine 180 in accordance with an embodiment of the invention. The engine 180 is typically implemented in software code. The software code can be implemented by, for example, use of known programming languages (e.g., C, C+, C++, or other suitable known languages). The memory 172 can also store a standard operating system 182 which permits the management of the operations in the apparatus 100.

In another embodiment of the invention, the engine 180 is included in a processor hardware 121 that is included in or coupled to the image processor 120. A saturation control engine 260 also performs operations that are discussed below and is typically implemented in software code. In another embodiment of the invention, the saturation control engine 260 is included in the processor hardware 121 instead of being embodied in software code. Therefore, in other embodiments of the invention, the processor hardware 121 can perform the functions of the engine 180 and/or the functions of the engine 260.

The storage medium 175 can also store the images of scenes 107 that are captured via the lens 105 and that are to be produced as pictures or photographs. The storage medium 175 can be a built-in memory device in the apparatus 100 or can be a removable memory device.

In accordance with an embodiment of the invention, the border frame color picker engine 180 determines a border frame color from a color set 185. The border frame color is in a border of a picture to be produced by the apparatus 100. The engine 180 selects the border frame color based upon the position of the selector 170 on the image 107*a*. For example, the engine 180 selects the border frame color by evaluating the color of pixels or selecting the colors of particular pixels in the image 107*a*. Various methods for using the selector 170 for selecting the particular pixels in the image 107*a* are discussed below with reference to the block diagrams in FIG. 2 and FIG. 3. For example, the selected pixels are overlaid by the selector 170, as discussed below in further details with reference to FIG. 2. As other examples, the image 107*a* can be reduced or shrunk down to fit within the border frame, or pixels in the image 107*a* can be magnified and selected, as discussed below with reference to the block diagrams in FIG. 3. As an additional example, the size of the selector 170 can be increased or decreased in order to fine tune the selection of pixels, as discussed below with reference to FIG. 3. The image processor 120 can execute the software code of the engine 180 so that various methods described herein are performed.

In accordance with another embodiment of the invention, the engine 180 determines a proper color set (e.g., non-grayscale color set 185, grayscale set 189, or sepia set 191), by evaluating the pixels in the image 107*a* by use of various methods, as discussed below in further detail. For example, the color set 185 contains non-grayscale colors, while the grayscale set 189 contains only the grayscale colors. Other color sets may be included as well for selection by the engine 180. For example, the engine 180 may select the sepia set 191 which contains sepia-related colors (e.g., brown, grayish brown, or olive brown similar to that of sepia ink) or other different color sets. The color sets 185, grayscale set 189, and sepia set 191 are typically stored in a memory device such as, for example, the memory 172.

The engine 180 makes use of metadata or file data of image 107*a* which is typically stored in memory 172 after a camera captures a photographic shot of the scene 107. This metadata or file data contains information that indicates if the picture of image 107*a* was taken as sepia, or black and white (grayscale), or non-grayscale color. Therefore, the engine 180 reads the metadata or file data in order to more accurately determine if the image 107*a* is sepia, grayscale, or non-grayscale color. When the engine 180 has selected the color set (e.g., color set 185, grayscale set 189, or sepia set 191), the engine 180 then selects the border frame color in the selected color set by evaluating or selecting the pixels in the image 107*a* based on the position of the cursor 107*a* on the image 107*a*, as discussed below with reference to FIG. 2 or FIG. 3. The colors in a set (e.g., sets 185, 189, and/or 191) may be arranged, for example, as a palette arrangement of colors or in other suitable arrangements.

Figure 2:
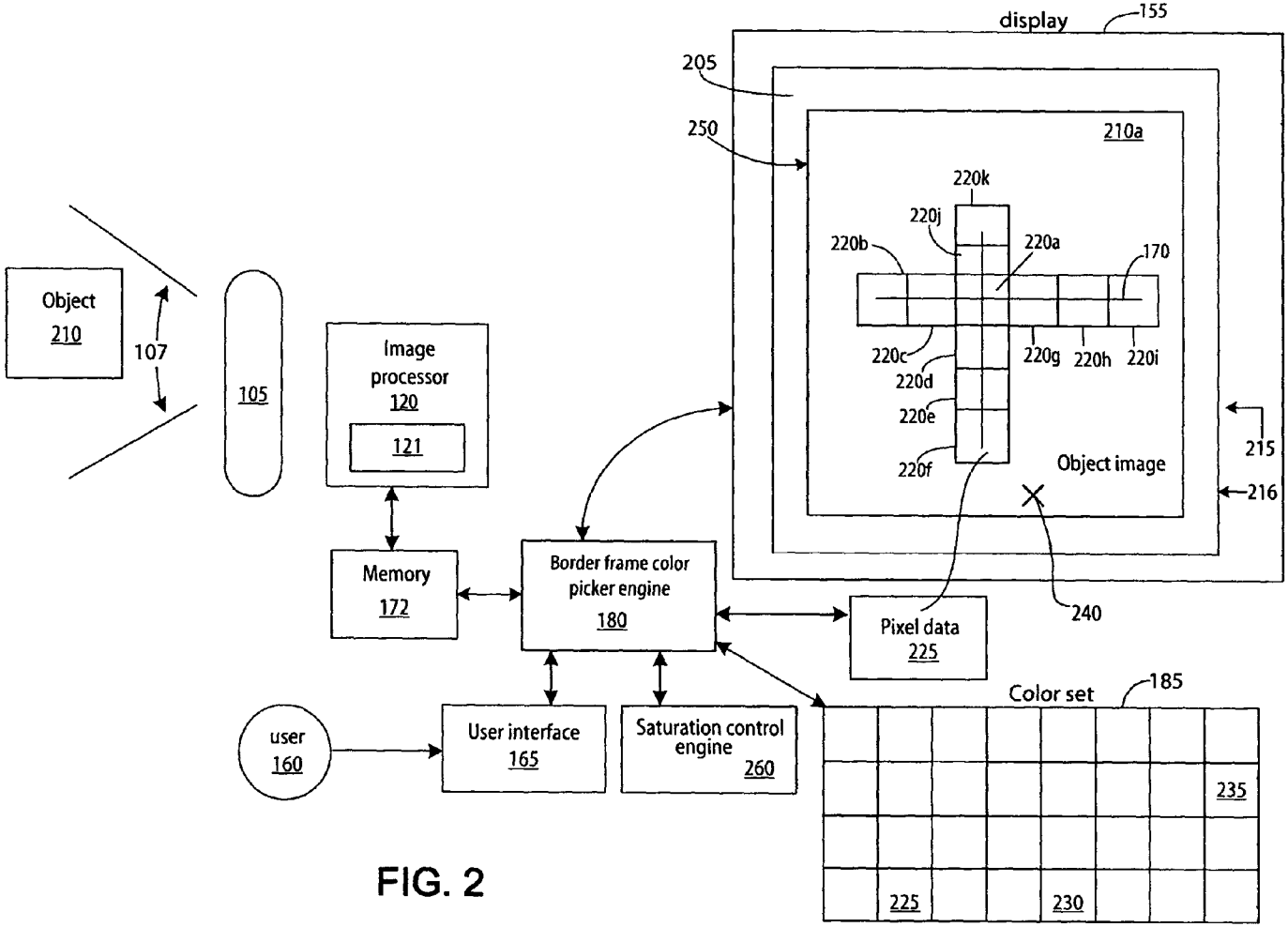
FIG. 2 is a block diagram that shows additional details of an embodiment of the invention.

FIG. 2 is a block diagram that illustrates additional details of an embodiment of the invention. The border frame color picker engine 180 determines the color 205 for the border frame 216 for an object image 210*a*. For purposes of clarity in the drawings, other components of the apparatus 100 are not shown in FIG. 2.

In an embodiment of the invention, the engine 180 selects the border frame color 205 from a color set 185. The color set 185 may be, for example, a set of colors arranged as a palette of colors.

An object 210 in a scene 107 is captured as an object image 210*a* and stored in the memory 172. The object image 210*a* and the border frame color 205 forms a picture (or photograph) 215 to be produced by the apparatus 100. The user 160 can also view the picture 215 in the display 155. The image processor 120 stores the picture 215 in the memory 172.

In the example of FIG. 2, the engine 180 brings about an overlay of the selector 170 on the object image 210*a* as shown in the display 155. However, in other examples, as shown in various block diagrams in FIG. 3, the engine 180 can instead reduce or shrink down the image 210*a* to fit completely within the border 216 of an image, instead of permitting an overlay with the selector 170 over the image 210*a*.

Figure 4:
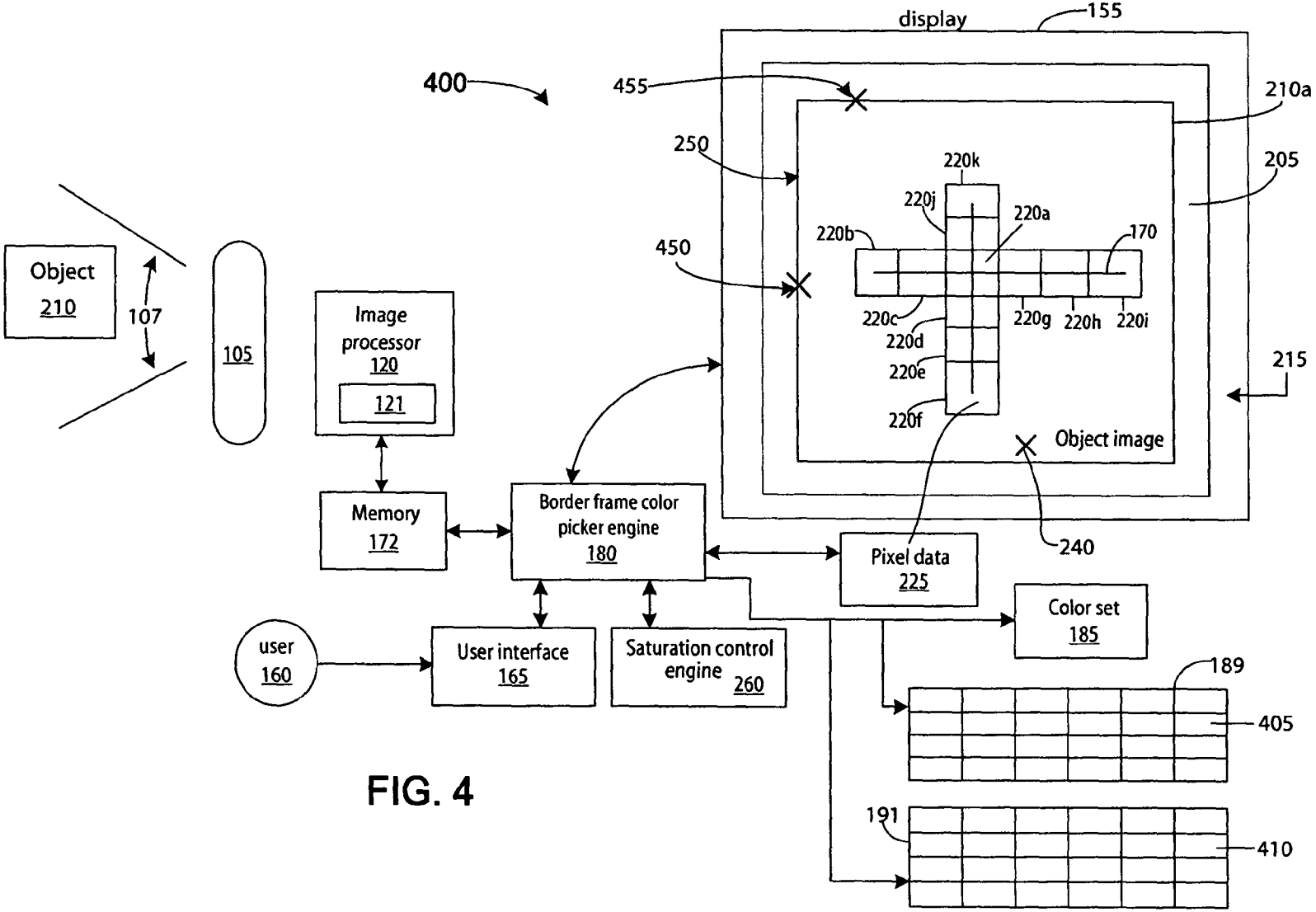
FIG. 4 is a block diagram that shows additional details of another embodiment of the invention.

The speed of the operations described in the block diagrams in FIG. 2 depends on the processing speed of the image processor 120. The image 210*a* can be reduced to fit within the border 216 if, for example, the stored area size of image 210*a* in memory 172 was originally larger than the area surrounded by the border 216. In both examples above, the overall goal is to find one or more suitable colors in the image 210*a* that could, for example, be matched with (or nearly matched with) a color in the color set 185. The position of the selector 170 in the image 210*a* determines the color to be selected from the image 210*a*. The evaluation of the pixel colors that are overlaid by the cursor 170 in FIG. 2 or pixel colors that are contained within the cursor 170 in the diagrams of FIG. 4 are discussed in detail below. The color (or colors) that are evaluated in the image 210*a*, based on the position of the selector 170, is then used to determine the color to be selected from the color set 185 (e.g., a color palette). The color selected from the color set 185 is then used as a border frame color 205.

In another embodiment of the invention, a color set (e.g., color set 185, grayscale set 189, or sepia set 191) is first selected based upon the evaluation of a color (or colors) with respect to the selector 170, and a color (from the color set) is then selected for the border frame color 205 based upon the evaluation of the color (or colors) with respect to the selector 170.

Typically, the selector 170 may be composed of two (or more) colors so that the selector 170 does not disappear or blend into a color of the object image 210*a*, although another embodiment may only use a selector 170 that is composed of only one color. As another example, the engine 180 outlines the colors of the selector 170 in gray bars (or other colors) and have the selector 170 outline the current color of the object image 210*a* in bright green bars (or other colors that differ from the selector 170 color), although another embodiment is not required to perform this optional feature. Other combination of example colors can be used as well.

Typically, the user 160 can drive and locate the selector 170 over any location on the object image 210*a* (or picture 215) by actuating a controller 167 (e.g., four-way buttons or other actuator types) in the user interface 165. The user 160 can drive and locate the selector 170 over locations on the object image 210*a* by other techniques that become available as user interface technology advances.

In an embodiment of the invention, the engine 180 selects a border frame color 205 that matches the color value of a pixel 220*a* (FIG. 2) of the object image 210*a*, where the pixel 220*a* is, for example, the central pixel of the selector 170. Alternatively, a color value of any of the pixels 220*a*-220*k* can be used by the engine 180 as a match for the border frame color 205. Note that the discussion below with reference to FIG. 4 also describes in detail the other possible techniques for selecting pixel colors in the image 210*a* (e.g., by changing the pixel sizes within a selector 170 as shown in FIGS. 3A-3C or by changing the selector size as shown in FIGS. 3D-3E). The engine 180 then selects (in the color set 185) a color 225 (FIG. 2) that matches or is the closest color value match to the color value of one of the pixels 220*a*-220*k*. The engine 180 can determine the color value of a pixel (e.g., pixel 220*a*) by checking a corresponding pixel data 225 that corresponds to the pixel.

Alternatively or additionally, the engine 180 selects a color 230 (FIG. 2) for the border frame color 205, where the color 230 is an average value (e.g., a mean value or a median value) of the color values of the pixels 220*a*-220*k* that are overlaid by the selector 170.

Note that the LCD resolution of a camera is typically on the order of approximately 1/60 of the width by 1/60 of the height of the original image stored in memory. This typical LCD image is called a "screennail" which differs from a "thumbnail" image. The screennail is approximately 320×240 pixels in size. Typically, the screennail is created by an averaging-technique where the color values of many pixels in an original image 107*a* are averaged together to obtain the screennail. Alternatively, the screennail can also be created by just selecting, for example, every $60^{th}$ pixel in an original image stored in memory, although this technique does not provide as a desirable picture as the above averaging technique. The above averaging technique creates a more applicable color for a general area of pixels in the original image, rather than a match for every single pixel in the original image. In other words, as an example, the color values of red pixels in an original image are not required to be averaged by the engine 180 in order to determine a border color 205, if a screennail image is shown in the camera display 155. The screennail already shows the average color values of the original image, and is not the original image stored in the memory which could be, for example, one-million or more pixels. Therefore, the pixel values in a location in a screennail are average pixel values that can be used as the border color 205. When the display 155 provides a screennail, the screennail automatically contains the average color values of the original image stored in memory. Therefore, the selector 170 can be placed in a location in the screennail, and the color values of pixels in this location are average color values from the original image. The color values in this location can then be used as border colors 205.

Alternatively or additionally, the engine 180 selects a color 235 that is at or near the opposite side of the color wheel from the color value of a pixel 220*a*. Note that the engine 180 can be programmed to select other colors in the color set 185 based on the pixels that are overlaid by the selector 170. For example, the color selected from the color set 185 may be near the color value of the color 225. As mentioned above, the selector 170 (which can be, e.g., circular or other shapes) can be resized and moved on various positions in the image 210*a* (as shown in FIGS. 3D-3E) by use of, e.g., buttons 167 in the user interface 165.

Alternatively, the image 210*a* area within the selector 170 can be magnified (zoomed) as shown in FIGS. 3A-3C. These techniques allows for fine tuning of the color that can be selected in the image 210*a* and used for the border color 205. If the selector 170 contains multiple pixels, then an average of the color values of the multiple pixels can be calculated by the engine 180 for use as the border color 205. When the selector 170 size is reduced (closer to a size that corresponds to a pixel), then the pixel that is contained in the selector 170 (or is overlaid by the selector 170) has a color value that is selected as the border color 205.

In another embodiment of the invention, the engine 180 provides the colors 225, 230, and 235 as a set of potential colors that the user 160 can select for the border frame color 205. Additionally, the engine 180 can permit the user 160 to select the color values near or in between the colors 225, 230, and 235 as possible choices for the border frame color 205. Therefore, the user 160 may have the option of fine tuning the color value to be used for the border frame color 205. The user 160 may use the user interface 165 in order to permit selection of the frame color 205 and for fine tuning of the frame color 205. As noted above, the image 210*a* that is seen on the display 155 is typically a screennail which is not the original image pixel data.

Note that the number of pixels that are overlaid by the selector 170, in the example of FIG. 2, may vary. Also, in actual implementations, the boundaries of the pixels on the display 155 may actually not be visible to the human eye. The sizes of the pixels in the display 155 have been enlarged in FIG. 2 to assist in describing the functionalities of embodiments of the invention. Therefore, the pixels in FIG. 2 and in FIGS. 3A-3E below are not necessarily drawn to scale.

Additionally, the number of colors in the color set 185 may vary in number. An advantage provided by embodiments of the invention is that the number of colors that can be provided in the color set 185 can now be increased and are no longer limited to a fixed number of colors of prior systems, and the border frame color picker engine 180 advantageously selects a color in the color set 185 for the border frame color 205. The engine 180 then displays the border frame color 205 in the picture 215 as shown on the display 155.

Note that when the user 165 moves the selector 170 to another location (e.g., location 240) in the object image 210*a*, the engine 180 determines and displays a potentially different color value for the border frame color 205. Therefore, as the user 165 drives the selector 170 in different locations in the object image 210, the border frame color 205 may change because other locations in the object image 210 may have different color values. The engine 180 displays, typically on the edge of the actual picture 215, the border color 205 as the user 165 is driving the selector 170 over different locations on the object image 210*a*. As mentioned above, this location 240 could also be magnified so that the particular color value at the pixel in position 240 is used as the border color 205.

Additionally or alternatively, an embodiment of the invention can use the saliency mapping method in order to determine the color value for the border frame color 205. For example, the engine 180 can detect the important features in the picture 215 by use of saliency mapping which detects the significant features of the image by detecting the edges 250 of the object image 210*a*, determining the focus area of the picture 215, and determining the location of the object 210*a* in the picture 215. As an example, the focus area is typically the position of the selector 170 in the image 210*a*. The saliency mapping methods are performed in various digital camera products that are commercially-available from HEWLETT-PACKARD COMPANY, Palo Alto, Calif.

The image of the border frame color 205 can time out (disappear from view in the display 155) after a given time frame has passed.

In another embodiment of the invention, a saturation control engine 260 selects a saturation level for the border frame color 205. The saturation control engine 260 provides a fixed number of saturation levels (e.g., 5 levels of saturation). The number of saturation levels can vary. As known to those skilled in the art, each saturation level provides a level of vividness and contains a certain mix of colors. For example, for the main colors in the color wheel (e.g., red, green, yellow, blue), each saturation level indicates certain mix levels of colors. As another example, for a grayscale color, the gray level in the grayscale color varies in amount for each saturation level.

Advantages of embodiments of the invention include increased ease-of-use of the camera by a user, matching the needed functionality to a simple interface mechanism in current cameras, and allows for the selected border frame color in a color palette to match the image. From an artistic viewpoint, embodiments of the invention advantageously provides a beneficial cohesive user interface that provides numerous options for an artist or user in selecting border colors, while also providing an ease of product use for users including users who are inexperienced with digital camera use.

Reference is now made to FIG. 3 which shows various diagrams that illustrate other methods for selecting a color or (colors) in an image 210*a* (or picture 215) in order to determine a color 205 for the border 216, in accordance with various embodiments of the invention. For purposes of clarity, assume in the examples of FIGS. 3A-3C that the selector 170 is a square shape area (or other shaped areas such as a circular or rectangular shape). In FIG. 3A, the image 210*a* has the pixels 305 that are, for example, within the selector 170. The pixels 305 include the pixels 305*a*-305*p* that are within the selector 170. The color selected from the color set 185 can be, for example, the average color values of the pixels 305*a*-305*p*, a color value of one of the pixels 305*a*-305*p*, a color value that is at or near the opposite side of the color wheel from the color value of one of the pixels 305*a*-305*p* (or that is at or near the opposite side of the color wheel from the average color values of the pixels 305*a*-305*p*).

In an embodiment of the invention, the border frame color picker engine 180 can magnify (enlarge) the image 210*a* stored in memory 172 by performing standard image magnification or image expansion techniques. When the image 210*a* is magnified, the pixels 305 become larger in area. For example, in FIG. 3B, the image 210*a* has been magnified so that the selector 170 only contains the magnified pixels 305*e*, 305*f*, 305*j*, and 305*k*. In FIG. 3C, the image 210*a* has been magnified further so that the selector 170 only contains a single pixel (e.g., pixel 305*e*).

By magnifying the image 210*a*, the resolution of the color selection for the border 216 is increased because the selector 170 can select only the colors of the pixel (or pixels) that is contained in the selector 170. Therefore, the selector 170 can select more specific pixel colors in the image 210*a* for use as the border color 205. In contrast, in FIG. 3A, the color selected by the selector 170 for the border color 205 is, for example, typically a blend of the different color values of pixels 305*a*-305*p* that are contained in the selector 170. This blend of color values can be for example, an average (e.g., mean or median) of the pixel color values.

As another example, the size and position of the selector 170 may be adjusted to different sizes as shown FIGS. 3D-3E to select the granularity (increments) of the selector 170 movements along the image 210*a*. The size of the selector 170 can be varied by use of, for example, actuators or buttons 167 (FIG. 1) in the user interface 165. As mentioned above, the selector 170 can have other shapes such as, for example, a cursor, cross-hair shape (FIG. 2), or other shapes that may be varied in size.

In FIG. 3D, assume, for example, that the selector 170 is initially at position 307 in the image 210*a*. Therefore, the selector 170 contains the pixels 310*a*-310*d* which can be evaluated in color values. Based on the evaluation of the color values of the pixels 310*a*-310*d* by the engine 180, the engine 180 can then select a color in the color set 185 (e.g., color palette) (FIG. 2) to be used for the border frame color 205. The selector 170 can be moved up or down or side-to-side (or even diagonally as an option) by use of buttons 167 or other actuator-types in the user interface 165. The buttons 167 can be, for example, the commonly-used 4-way rocker button. If the user 160 moves (312) the selector 170 to another position 315 in the image 210*a*, then the selector 170 contains the different pixels 311*a*-311*d* with color values that are evaluated by the engine 180 for use as the border color 205.

In FIG. 3E, the user 160 can reduce the size of the selector 170 so that the selector 170 contains, for example, only the pixel 310*a*. Alternatively, the user 160 can increase the size of the selector 170 so that the selector 170 contains, for example, the pixels 310*a*-310*d* (FIG. 3D) and additional pixels. In FIG. 3E, based on the evaluation of the color value of the pixel 310*a* by the engine 180, the engine 180 can then select a color in the color set 185 (e.g., color palette)) to be used for the border frame color 205. Therefore, decreasing the selector 170 size permits a more precise evaluation of colors in the image 210*a*.

Additionally, decreasing the selector size 170 permits the user to select the granularity (increments) of the selector 170 movements. For example, in FIG. 3E, the user can move (320) the selector 170 at two increments from position 325 to position 330. When the selector 170 is at position 330, the selector 170 then contains, for example, the pixel 332 with a color value that is evaluated by the engine 180. As another example, the user can instead move the selector 170 at one increment from position 325 so that selector 170 then contains, for example, the pixel 310*b* with a color value that is evaluated by the engine 180. Therefore, by reducing the size of the selector 170, the user can have a finer movement of the selector 170 along pixels in the image 210*a*. Adjusting the size of the selector 170 allows for "bigger selector jumps" (i.e., selector moves that spans more pixels) and allows for "fine-tuning selector jumps" (i.e., selector moves that spans one or only a few pixels). The adjustment of the selector size 170 permits a user to select color values in a particular location in the image 210*a* and the once the selector 170 is placed in that particular location (e.g., pixels 310*a*-310*d* in FIG. 3D), then the user can magnify (increase the pixel size) or decrease the selector 170 size in order to choose a very specific color (e.g., the color value of pixel 310*a* in FIG. 3E) for the border frame color 205.

In the example of FIG. 3C, the image 210*a* is magnified so that there is a 1-to-1 correspondence between a pixel color value in the selector 170 and the color value that is selected for the border color 205. The ability to magnify an original image 210*a* as discussed above or to perform other fine tuning methods (e.g., selector 170 size adjustments) at an image location is advantageous if the camera display 155 does not provide a screennail image of the original image 107*a* stored in the memory 172.

Alternatively, the user can view, in the display 155, the original image stored in memory 172, instead of viewing a screennail in the display 155. In this alternative approach, it is advantageous to provide a method to fine tune the viewing of the millions of pixels of the original image by, for example, magnifying the selected pixels (e.g., FIGS. 3A-3C) or by adjusting the size of the selector 172 (e.g., FIGS. 3D-3E).

FIG. 4 is a block diagram of a system 400 that implements a method used by the border frame color picker engine 180 in order to determine a proper color set (e.g., color set 185 or grayscale set 189 or sepia set 191) that contains a color value for the border frame color 205. The engine 180 analyzes the image data and/or metadata (pixel data) 225 for a pixel(s)

with respect to the position of the selector 170, in order to determine if the object image 210*a* is a grayscale image or color image (or sepia color image or other image). As in the method of FIG. 2 above, the engine 180 may evaluate the pixel 220*a* which is at the center of the selector 170 or evaluate other pixels overlaid by the selector 170, or may evaluate an average color value or mean color value of the pixels 220*a*-220*k* that are overlaid by the selector 170. As other examples, FIG. 3 shows other methods for selecting and evaluating the pixel color values by use of the selector 170.

In another embodiment, the engine 180 uses saliency mapping to detect the significant features of the image 210*a* in the selector 170 area, and then evaluate the pixel color values of these significant features in the selector 170 area. The engine 180 selects the color set (e.g., set 185, set 189, or set 191) by evaluating the color (or colors) in a salient area 450 or 455 and then selects a color from the selected color set for the border color 205 by the evaluation of the color (or colors) in a salient area. The color evaluation methods discussed above with reference to FIGS. 2 or 3 may be used by the engine 180 to evaluate a color or colors in a salient area.

In another embodiment, the engine 180 moves the selector 170 from one salient area to another salient area. For example, if the selector 170 was in the salient area 350, when the user attempts to move the selector 170 away from the salient area 450, then the engine 180 would move the selector 170 to another salient area 455. Additionally or alternatively, a button or actuator 167 in the user interface 165 can permit the user to move the selector 170 to the various salient areas. Therefore, the selector 170 jumps to and from the salient areas. The user can then select the specific areas of a salient area to evaluate a color value or color values by use of the fine-tuning color selection methods described above with reference to FIG. 2 or FIG. 3.

If the object image is a color image (i.e., non-grayscale color image), then the engine 180 selects the color set 185 to provide possible color values (non-grayscale color values) for the border color 205. If the image is a grayscale image, then the engine 180 selects the grayscale set 185 to provide possible grayscale color values for the border color 205. The colors in the grayscale value are neutral colors such as, for example, tan, ivory, white, beige, black, white, and/or other grayscale colors. If the image is a sepia image, then the engine 180 selects the grayscale set 185 to provide possible sepia color values for the border color 205. The color set 191 may be a sepia palette which contains color values ranging from brown, grayish brown, and olive brown similar to that of sepia ink.

The engine 180 may also select other color sets for providing the border color 205. For example, the engine 180 may select a color set based on the evaluation of the pixels that are overlaid by the selector 170 or pixels that are located with respect to the position of the selector 170 as shown in FIGS. 3A-3D. When the engine 180 has selected the color set 185, 189 or 191 as the color set for providing the border frame color 205, the engine 180 then selects a color value from the color set as similarly described in the methods of FIG. 2 or FIG. 3. For example, the engine 180 can select the color value 405 in the grayscale color set 189 as the border color 205 if the object image 210*a* is a grayscale image. As another example, the engine 180 can select the color value 410 in the sepia color set 191 as the border color 205 if the object image 210*a* is a sepia colored image.

Advantages of embodiments of the invention include the following. The engine 180 advantageously reduces or narrows down the number of selections of color values for use in the border frame color. As a result, the un-useful color values in a color palette are eliminated for consideration as a border frame color. The engine 180 automatically determines the possible border frame colors and as a result, the user is not required to perform numerous button selections or presses in the user interface 165. In this manner, the user is able to more quickly scan through the black and white palette for potential grayscale values for the border frame color or scan through a palette with non-grayscale color values or with sepia color values.

The black and white palette provides a separate palette that is dedicated for a grayscale image. As a result, more flexibility is provided to select a frame color for a grayscale image.

Currently available features in digital cameras may also be used to help the user 160 to select among the potential border frame color values that are identified by the engine 180. For example, the user 160 can use the known "live view" mode which permits the user 160 to look at the image scene 107 in the display 155, while the camera captures the image scene 107 for a picture 215. As another example, the user 160 can use the known playback mode which stores the image scene 106 as an scene image in the memory 172. The user 160 can then use the user interface 165 to view a larger pixel sample or smaller pixel sample of the scene image. Increasing or decreasing the pixel sample of the object image 210 changes the number of pixels that are overlaid by a selector 170 or are contained within a selector 170, depending on the shape of the selector 170. As a result, the color value determined by the engine 180 for the border color 205 may potentially differ if the number of pixels overlaid by the selector 170 are increased or decreased.

Figure 5:
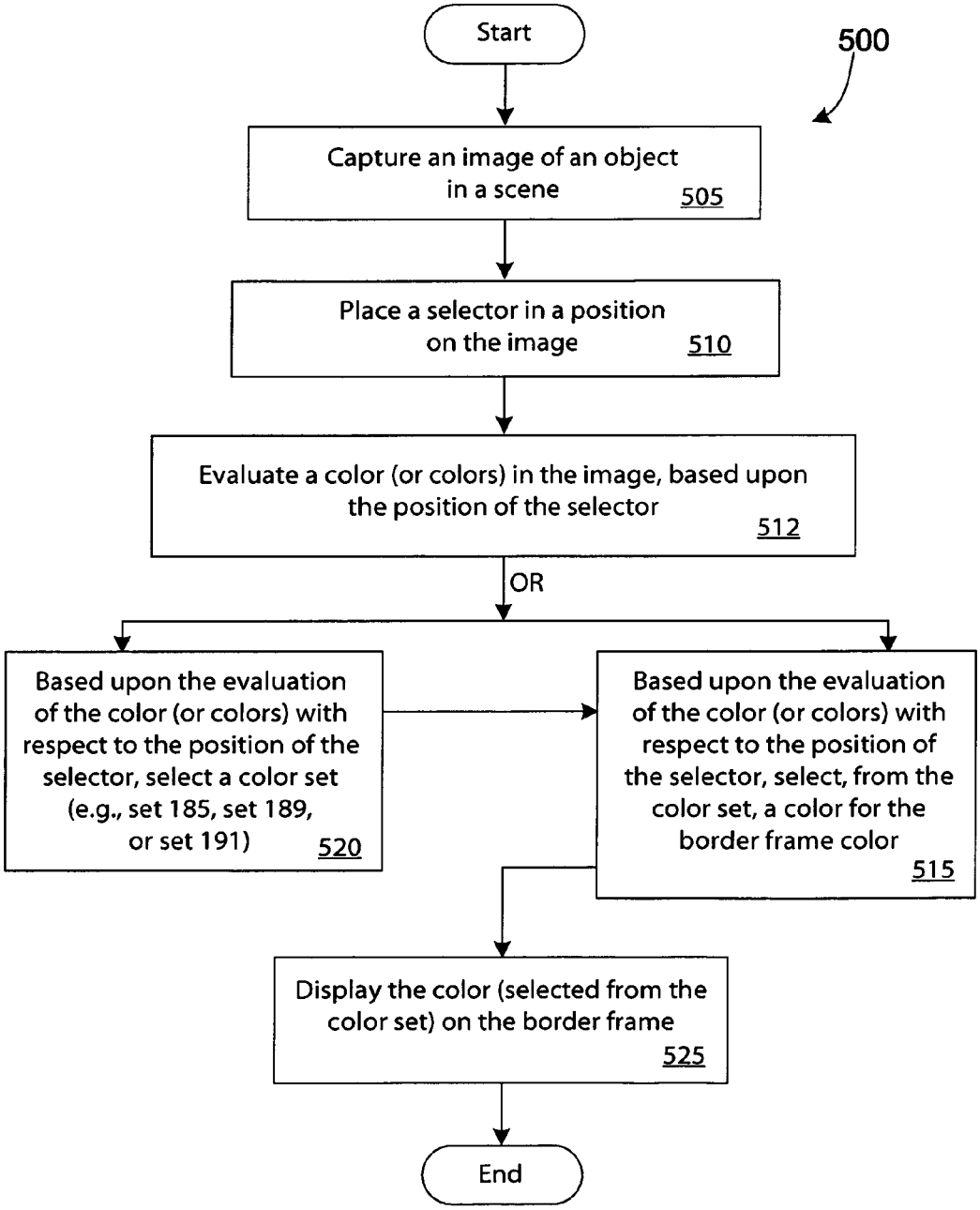
FIG. 5 is a flow diagram of a method in accordance with an embodiment of the invention.

FIG. 5 is a flow diagram of a method 500 in accordance with an embodiment of the invention. In block 505, a camera captures an image of an object 210 in a scene 107. In block 510, the border frame color picker engine 180 places a selector 170 in a position in the image 210*a*. In block 512, the engine 180 evaluates a color (or colors) in the image 210*a*, based upon the position of the selector 170. The colors can be evaluated by the techniques discussed with reference to FIGS. 2 or 3 above. In block 515, based upon the evaluation of the color (or colors) with respect to the position of the selector 170, the engine 180 selects (from a color set) a color for the border frame color 205. In another embodiment of the invention, the engine 180 performs the step in block 520 before performing the step in block 515. In block 520, based upon the evaluation of the color (or colors) with respect to the position of the selector 170, the engine 180 selects a color set (e.g., set 185, set 189, or set 191) that will provide a color for the border frame color 205. In block 525, the engine 180 will cause the display of the color (which is selected from the color set) on the border frame.

It is also within the scope of the present invention to implement a program or code that can be stored in a machine-readable or computer-readable medium to permit a computer to perform any of the inventive techniques described above, or a program or code that can be stored in an article of manufacture that includes a computer readable medium on which computer-readable instructions for carrying out embodiments of the inventive techniques are stored. Other variations and modifications of the above-described embodiments and methods are possible in light of the teaching discussed herein.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. An apparatus for selecting a color for a border frame, the apparatus comprising:

a digital device including a border frame color picker engine configured to place a selector on a location on an object image, to select an adjustable size for the selector, and to select a color for the border frame, based on the location and the size of the selector on the object image, wherein the color for the border frame is approximately equal to a color value of a pixel in the location of the selector.

2. The apparatus of claim 1, wherein the color is selected from a color set.

3. The apparatus of claim 1, wherein the color for the border frame is approximately opposite in value to a color value of a pixel in the location of the selector.

4. The apparatus of claim 1, wherein the color for the border frame is approximately equal to an average of color values of pixels in the location of the selector.

5. The apparatus of claim 1, wherein the border frame color picker engine fine tunes the color to be used for the border frame by selecting another color that is near a value of the previous color for the border frame.

6. The apparatus of claim 1, further comprising:

a saturation control engine configured to select a saturation level for the color for the border frame.

7. The apparatus of claim 1, wherein the selector comprises a cross-hair or a pre-defined shaped area.

8. The apparatus of claim 1, wherein the border frame color picker engine is configured to use a significant feature of the object image in determining the color for the border frame.

9. The apparatus of claim 1, wherein the border frame color picker engine is configured to magnify pixel sizes in the location of the selector by adjustment of the adjustable size of the selector, in order to select various color values for determining the color for the border frame.

10. The apparatus of claim 9, wherein a color value of a pixel within the location of the selector is used to determine the color for the border frame.

11. The apparatus of claim 1, wherein the border frame color picker engine is configured to adjust a size of the selector, in order to select various color values for determining the color for the border frame.

12. The apparatus of claim 11, wherein a color value of a pixel within the location of the selector is used to determine the color for the border frame.

13. The apparatus of claim 1, wherein the border frame color picker engine is configured to move the selector to and from salient areas of the object image, in order to select various color values for determining the color for the border frame.

14. The apparatus of claim 13, wherein the border frame color picker engine is configured to select the color for the border frame, based on a location of the selector on a salient area.

15. The apparatus of claim 1, wherein the border frame color picker engine is configured to select a color set that provides the color for the border frame, based on the location of the selector on the object image.

* * * * *

UNITED STATES PATENT AND TRADEMARK OFFICE

CERTIFICATE OF CORRECTION

PATENT NO. : 7,746,353 B2
APPLICATION NO. : 11/606548
DATED : June 29, 2010
INVENTOR(S) : Robert P. Cazier et al.

It is certified that error appears in the above-identified patent and that said Letters Patent is hereby corrected as shown below:

In the Claims:

In column 12, line 9, in Claim 9, delete "selector," and insert -- selector so that a number of pixels that are overlaid by the selector is reduced, --, therefor.

In column 12, line 18, in Claim 11, delete "frame." and insert -- frame;

wherein adjustment of the size of the selector comprises one of:

increasing the size of the selector in order to increase a number of pixels that are overlaid by the selector; and decreasing the size of the selector in order to decrease the number of pixels that are overlaid by the selector. --, therefor.

Signed and Sealed this

Twenty-sixth Day of October, 2010

David J. Kappos

David J. Kappos
*Director of the United States Patent and Trademark Office*